US008752381B2

(12) United States Patent
Bronicki et al.

(10) Patent No.: US 8,752,381 B2
(45) Date of Patent: Jun. 17, 2014

(54) ORGANIC MOTIVE FLUID BASED WASTE HEAT RECOVERY SYSTEM

(75) Inventors: Lucien Y Bronicki, Yavne (IL); Yoram Bronicki, Reno, NV (US)

(73) Assignee: Ormat Technologies Inc., Reno, NV (US)

( * ) Notice: Subject to any disclaimer, the term of this patent is extended or adjusted under 35 U.S.C. 154(b) by 443 days.

(21) Appl. No.: 12/765,452

(22) Filed: Apr. 22, 2010

(65) Prior Publication Data

US 2011/0259010 A1 Oct. 27, 2011

(51) Int. Cl.
*F01K 25/08* (2006.01)

(52) U.S. Cl.
CPC ..... *F01K 25/08* (2013.01)
USPC ..... 60/651; 60/671

(58) Field of Classification Search
CPC ..... F01K 25/04; F01K 25/08; F01K 7/34; F01K 7/345; F01K 7/40; F01K 7/42; F01K 7/44
USPC ..... 60/651, 671, 653, 677, 679, 660, 662, 60/663, 641.5
See application file for complete search history.

(56) References Cited

U.S. PATENT DOCUMENTS 3,934,533 A * 1/1976 Wainwright ..... 114/39.31
4,441,322 A * 4/1984 Ritzi ..... 60/649
4,452,180 A * 6/1984 Hassan ..... 122/1 A
4,557,112 A * 12/1985 Smith ..... 60/651
4,573,321 A * 3/1986 Knaebel ..... 60/649
5,181,381 A * 1/1993 Gounder ..... 60/648
5,361,585 A * 11/1994 Westphal et al. ..... 60/646
5,531,073 A 7/1996 Bronicki et al.
5,671,601 A * 9/1997 Bronicki et al. ..... 60/641.5
5,754,613 A * 5/1998 Hashiguchi et al. ..... 376/378
5,970,714 A * 10/1999 Bronicki et al. ..... 60/641.3
6,571,548 B1 * 6/2003 Bronicki et al. ..... 60/772
6,960,839 B2 * 11/2005 Zimron et al. ..... 290/2
7,225,621 B2 * 6/2007 Zimron et al. ..... 60/651
7,340,897 B2 * 3/2008 Zimron et al. ..... 60/641.1
7,823,386 B2 * 11/2010 Zimron et al. ..... 60/651
8,181,463 B2 * 5/2012 Batscha et al. ..... 60/653
2003/0213246 A1 * 11/2003 Coll et al. ..... 60/653
2005/0274113 A1 * 12/2005 Sekiai et al. ..... 60/660
2007/0240420 A1 * 10/2007 Bronicki ..... 60/671
2008/0060357 A1 * 3/2008 Zimron et al. ..... 60/651
2009/0320473 A1 * 12/2009 Krieger et al. ..... 60/641.2

(Continued)

OTHER PUBLICATIONS

RM Price, Flash Distillation 2003.*

(Continued)

*Primary Examiner* — Thomas Denion
*Assistant Examiner* — Steven D Shipe
(74) *Attorney, Agent, or Firm* — Oblon, Spivak, McClelland, Maier & Neustadt, L.L.P.

(57) ABSTRACT

A waste heat recovery system includes a closed fluid circuit through which an organic motive fluid flows, and a heat exchanger for transferring heat from waste heat gases to the motive fluid. A first flashing unit flashes the motive fluid which exits the heat exchanger into a high pressure flashed vapor portion. Another flashing unit flashes liquid non-flashed motive fluid, producing a low pressure flashed vapor portion. A high pressure turbine module receives the high pressure flashed vapor portion to produce power, and a low pressure turbine module receives a combined flow of motive fluid vapor comprising the low pressure flashed vapor portion and discharge vapor from the high pressure turbine module whereby additional power is produced.

18 Claims, 1 Drawing Sheet

(56) References Cited

U.S. PATENT DOCUMENTS

2010/0071368 A1* 3/2010 Kaplan et al. ..... 60/651
2010/0089058 A1 4/2010 Harrington
2011/0041502 A1* 2/2011 Zimron et al. ..... 60/641.15
2013/0341929 A1* 12/2013 Ho et al. ..... 290/54

OTHER PUBLICATIONS

International Search Report issued Dec. 1, 2011 in PCT/IB 11/00841.

* cited by examiner

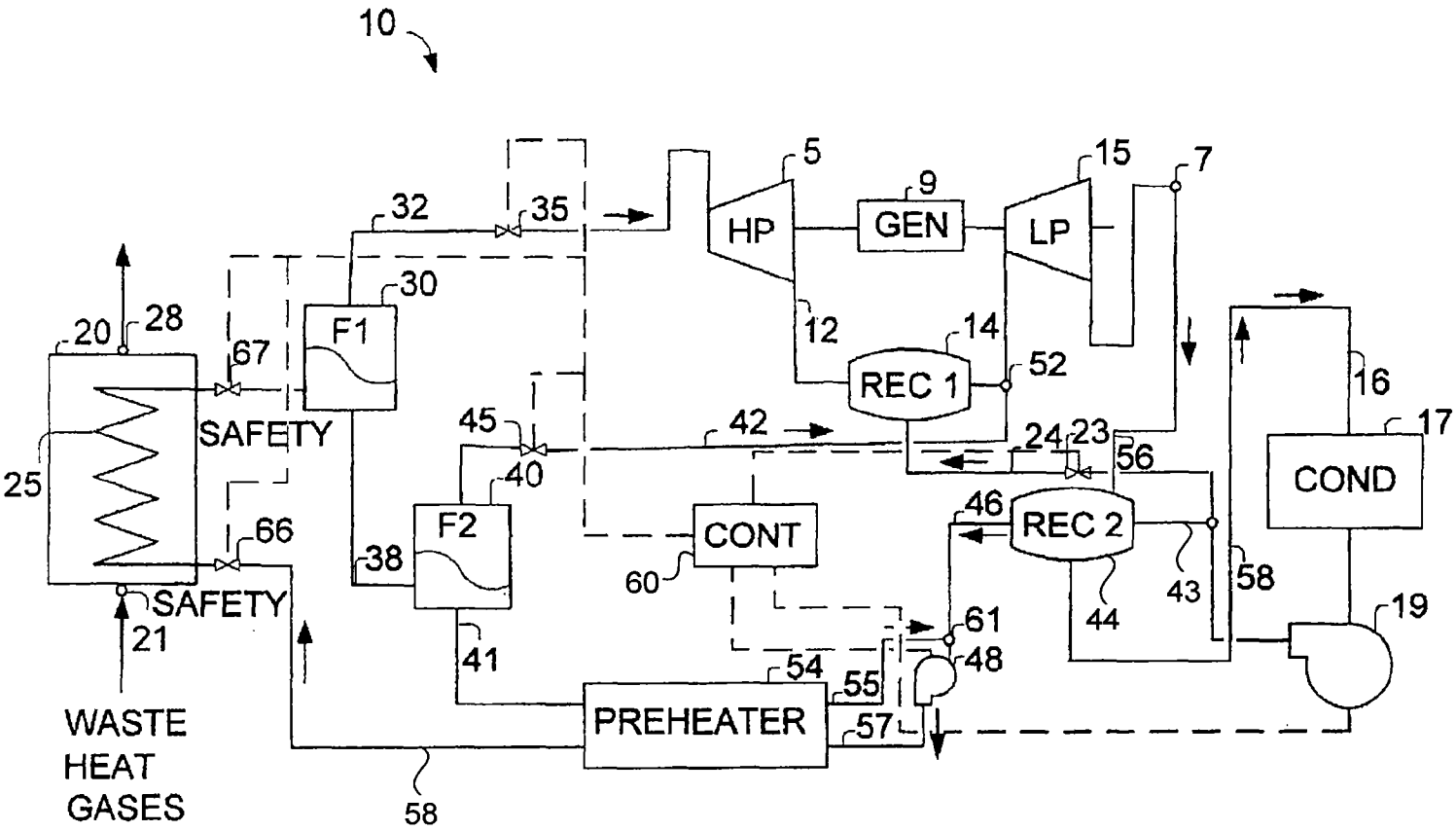
10
COND
17
16
19
58
7
15
LP
52
14
REC 1
9
GEN
5
HP
12
56
23
24
REC 2
43
44
46
61
48
55
57
54
PREHEATER
42
CONT
60
35
32
30
F1
38
45
40
F2
41
58
SAFETY
67
66
SAFETY
28
20
25
21
WASTE
HEAT
GASES

ORGANIC MOTIVE FLUID BASED WASTE HEAT RECOVERY SYSTEM

The present invention relates to the field waste heat recovery systems. More particularly, the invention relates to a waste heat recovery system employing a directly heated organic motive fluid.

Many waste heat recovery systems employ an intermediate heat transfer fluid to transfer heat from waste heat gases, such as the exhaust gases of a gas turbine, to a power producing organic Rankine cycle (ORC). One of these waste heat recovery systems is disclosed in U.S. Pat. No. 6,571,548, for which the intermediate heat transfer fluid is pressurized water. Another prior art waste heat recovery system is disclosed in U.S. Pat. No. 6,701,712, for which the intermediate heat transfer fluid is thermal oil.

The thermal efficiency of such prior art waste heat recovery systems is reduced due to the presence of the intermediate heat transfer fluid. In addition, the capital and operating costs associated with the intermediate fluid system are relatively high.

It would therefore be desirable to obviate the need of an intermediate fluid system by providing a direct heating organic Rankine cycle, i.e. one in which heat is transferred from waste heat gases to the motive fluid without any intermediate fluid circuit. However, a directly heated organic motive fluid achieves higher temperatures than one in heat exchanger relation with an intermediate fluid, and therefore suffers a risk of degradation and ignition when brought to heat exchanger relation with waste heat gases and heated thereby.

The present invention provides a waste heat recovery system based on a direct heating organic Rankine cycle.

In addition, the present invention provides a direct heating organic Rankine cycle which safely, reliably and efficiently extracts the heat content of waste heat gases to produce power.

Other advantages of the invention will become apparent as the description proceeds.

The present invention provides a waste heat recovery system, comprising a closed fluid circuit through which an organic motive fluid flows, heat exchanger means for transferring heat from waste heat gases to said motive fluid, means for flashing the motive fluid which exits said heat exchanger means into a high pressure flashed vapor portion, means for flashing liquid non-flashed motive fluid producing a low pressure flashed vapor portion, a high pressure turbine module which receives said high pressure flashed vapor portion to produce power, and a low pressure turbine module which receives a combined flow of motive fluid vapor comprising said low pressure flashed vapor portion and discharge vapor from said high pressure turbine module whereby additional power is produced.

The flashing means preferably comprises a high pressure flash chamber for receiving the motive fluid exiting the heat exchanger means and producing the high pressure flashed portion, and, in addition, a low pressure flash chamber receives a non-flashed discharge from said high pressure flash chamber and produces the low pressure flashed portion.

The system preferably further comprises a direct contact recuperator, a condenser for condensing a discharge from the low pressure turbine module, and a condensate pump for delivering at least a portion of the motive fluid condensate to said direct contact recuperator for mixing with the high pressure turbine module vapor discharge, a mixed flow exiting from said direct contact recuperator combining with the low pressure flashed portion to produced the combined flow introduced to the low pressure turbine module.

According to another aspect of the present invention, the system further comprises a second recuperator for heating a second portion of the motive fluid condensate using the low pressure turbine module discharge.

In accordance with a further aspect of the present invention, the system further comprises a preheater for preheating condensate from the second recuperator using non-flashed discharge from the low pressure flash chamber.

According to an additional aspect of the present invention, heat depleted low pressure flash chamber discharge is combined with condensate from the second recuperator.

In accordance to a still further aspect the present invention, the system further comprises a feed pump for delivering the condensate to the heat exchanger means at a sufficiently high pressure so that the condensate will be retained in a liquid phase.

According to an still additional aspect of the present invention, the system further comprises a first control valve in communication with a fluid line extending from the high pressure flash chamber to the high pressure turbine module, a second control valve in communication with a fluid line extending from the low pressure flash chamber and the low pressure turbine module, and a third control valve in communication with a fluid line extending from the condensate pump to the direct contact recuperator.

Moreover, in accordance to a still further aspect the present invention, the system further comprises a first safety valve in communication with a fluid line extending from the heat exchanger means and the high pressure flash chamber, and a second safety valve in communication with a fluid line upstream to the heat exchanger means.

In accordance to a still additional aspect the present invention, the system further comprises a controller for controlling operation of the condensate pump, first control valve, second control valve, third control valve, first safety valve and second safety valve in accordance with sensed operating conditions.

According to an even additional aspect of the present invention, the high pressure and low pressure turbine modules can be separate turbine modules which can be coupled to a common generator.

Moreover, in accordance to a still further aspect the present invention, the high pressure and low pressure turbine modules are first and second stages, respectively, of a common turbine coupled to a generator.

In the drawings:

FIG. 1 is a block diagram of a waste recovery system, according to one embodiment of the invention.

The present invention is a flash chamber based waste heat recovery system. A heated organic motive fluid, e.g. butane, such as n-butane or isobutane, pentane e.g. n-pentane or isopentane, or hexane, e.g. n-hexane or isohexane is introduced into a flash chamber system as a heated motive fluid liquid supplied from a waste heat heat exchanger and is separated into high and low pressure portions. Other organic motive fluids such as alkalyted substituted aromatic fluids, dodecane, isododecane, etc. can also be used in the present invention. The high pressure portion is delivered to a high pressure turbine module and is expanded therein, thereby producing power. The discharge from the high pressure turbine module is combined with a low pressure portion, and is delivered to a low pressure turbine module. Thus, the waste heat recovery system of the present invention is able to realize an increased level of power while advantageously ensuring the use of liquid motive fluid in the waste heat heat exchanger thereby preventing a risk of degradation of the motive fluid.

FIG. 1 illustrates a waste heat recovery system, which is designated by numeral 10. In system 10, the organic motive fluid flowing in a closed fluid circuit is brought in heat exchanger relation with waste heat gases, such as the exhaust gases of a gas turbine, a diesel engine, a gas engine or a furnace, etc. e.g. at a temperature of about 500° C. As the waste heat gases are introduced to inlet 21 of heat exchanger 20 and discharged from outlet 28 thereof after flowing through the interior of heat exchanger 20, the motive fluid circulates through heating coils 25 positioned within heat exchanger 20 and is heated by the waste heat gases, which flow over the heating coils. The operating conditions of system 10 are such that the motive fluid introduced to heating coils 25 is maintained in a liquid phase, to advantageously increase the heat transfer rate between the waste gases and the motive fluid.

The heated motive fluid exiting heat exchanger 20 is introduced via line 29 to high pressure flash chamber 30, in which its pressure is quickly reduced to produce motive fluid vapor. The motive fluid vapor produced flows through line 32 with which control valve 35 is in communication and is delivered to high pressure turbine module 5 wherein the vapor expands to produce power. The liquid motive fluid which is not flashed exits high pressure flash chamber 30 via line 38 to low pressure flash chamber 40 in which low pressure motive fluid vapor is produced. The low pressure motive fluid vapor produced flows through line 42 with which control valve 45 is in communication and is supplied to low pressure turbine module 15 wherein the vapor expands to produce power. The liquid motive fluid which is not vaporized exits low pressure flash chamber 40 via line 41 and is supplied to preheater 54, in order to transfer heat to condensate.

In the illustrated embodiment, high pressure turbine module 5 and low pressure turbine module 15 are two separate turbine modules which can be both coupled to a common generator 9, by which electricity is produced. Alternatively, a single two-stage turbine having a high pressure stage and a low pressure stage which is coupled to generator 9 can be used. The turbines may be configured with large shafts about which each turbine component is independently rotatable and with correspondingly large bearings on which the shafts are rotatably mounted. By employing such a cost effective turbine configuration of relatively large dimensions, the rotational speed of the turbines can be lowered. Thus, the rotational speed of the turbines can be synchronized with that of generator 9, to a relatively low speed of e.g. 1500-1800 rpm, thereby enabling the use of a relatively inexpensive generator.

The motive fluid discharged from low pressure turbine module 15 is delivered via line 16 to condenser 17. Cycle pump 19 can deliver a first portion of the condensate to direct contact recuperator 14 via line 24 and control valve 23 in communication therewith, and a second portion of the condensate to recuperator 44 via line 43. Recuperator 14 can receive expanded motive fluid vapor discharged from high pressure turbine module 5 via line 12, and the first portion of the condensate flowing through line 24 can be mixed with the high pressure turbine module vapor discharge to increase the mass flow rate of motive fluid introduced to low pressure turbine module 15 and thereby the power output of turbine module 15. In addition, motive fluid introduced to low pressure turbine module 15 further includes motive fluid vapor discharged from low pressure flash chamber 40 via line 42. The motive fluid vapor discharged from low pressure flash chamber 40 can be combined with the discharge from recuperator 14 at junction 52 before being delivered to turbine module 15.

Advantageously, the discharge from turbine module 15 can be supplied to recuperator 44 via line 56, in order to heat the second condensate portion supplied thereto by line 43. Heat depleted turbine discharge exiting recuperator 44 is delivered via line 16 to condenser 17.

The heated motive fluid condensate exiting recuperator 44 is combined at junction 61 with the heat depleted liquid discharge from low pressure flash chamber 40 which flows to junction 46 via line 55, and the combined flow flows to the suction side of pump 48. Pump 48 delivers the combined flow to preheater 54 via line 57, and the combined flow is heated by the liquid discharge from low pressure flash chamber 40. Cycle pump 19 together with pump 48 are adapted and controlled to ensure that the preheated condensate flowing to heat exchanger 20 via line 58 is in a liquid phase. Safety valves 66 and 67 are deployed upstream and downstream, respectively, of heat exchanger 20, to ensure that a sufficiently high flow rate of liquid motive fluid is supplied thereto and thereby, in addition, prevent a risk of degradation of the motive fluid.

Waste heat recovery system 10 is also provided with controller 60, for controlling the operation of cycle pump 19, condensate pump 48, control valves 23, 35 and 45, and of safety valves 66 and 67. The dashed lines represent the connections of the control system.

The control system is adapted to activate/deactivate and control the operation of cycle pump 19 as well as condensate pump 48 and to actuate safety valves 66 and 67 to ensure sufficient flow rate of liquid motive fluid flows in waste heat heat exchanger 20 as well as in lines 29 or 58. Control valves 35 and 45 are regulated by controller 60 in order to deliver a desired pressure level of motive fluid vapor to turbine modules 5 and 15, respectively. Control valve 23 is regulated so that an optimal flow rate of motive fluid condensate can be supplied to direct contact recuperator 14, in order that, on one hand, a sufficiently high flow rate of motive fluid vapor will be delivered to low pressure turbine module 15 for the production of power thereby, as well as ensuring that the condensate flow rate supplied by control valve 23 will be such that the motive fluid vapor supplied to low pressure turbine module 15 will have a certain level of superheat to ensure effective power production by low pressure turbine module 15. In such a manner, the blades of low pressure turbine module 15 are not liable to become corroded since the temperature-entropy graph of organic fluid is skewed. That is, the critical point on an entropy-temperature diagram delimiting the interface between saturated and superheated regions is to the right of the centerline of an isothermal boiling step and of the centerline of an isothermal condensing step. Accordingly, expansion of vapor within low pressure turbine module 15 will cause the organic motive fluid to become superheated.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A waste heat recovery system, comprising:

a closed fluid circuit through which an organic motive fluid flows, a heat exchanger connected to receive waste heat combustion gases and communicating with said closed fluid circuit for transferring heat from the waste heat combustion gases to an organic motive fluid liquid flowing in said heat exchanger in the closed fluid circuit, first organic motive fluid flashing means connected to said closed fluid circuit at a position of the closed fluid circuit for flashing the organic motive fluid liquid which exits said heat exchanger into a high pressure flashed organic motive fluid vapor portion, second organic motive fluid flashing means connected to said closed fluid circuit at a position of the closed fluid circuit for flashing liquid remaining non-flashed organic motive fluid, producing a low pressure flashed organic motive fluid vapor portion, a high pressure organic vapor turbine module connected to said closed fluid circuit at a position of the closed fluid circuit to receive said high pressure flashed organic motive fluid vapor portion directly from the first organic motive fluid flashing means to produce power, a low pressure organic vapor turbine module connected to said closed fluid circuit at a position of the closed fluid circuit to directly receive a combined flow of organic motive fluid vapor comprising said low pressure flashed organic motive fluid vapor portion from the second organic motive fluid flashing means and discharge organic motive fluid vapor from said high pressure organic vapor turbine module, whereby additional power is produced, an organic motive fluid recuperator for receiving high pressure organic vapor discharged from said high pressure organic vapor turbine module, a further organic motive fluid recuperator for receiving low pressure organic vapor discharged from said low pressure organic vapor turbine module, an organic vapor condenser for condensing discharge organic vapor from the low pressure organic vapor turbine module, the organic vapor condenser producing organic motive fluid condensate for supply to said heat exchanger, and a cycle pump for delivering a portion of the organic motive fluid condensate to said organic motive fluid recuperator and for delivering a further portion of the organic motive fluid condensate to said further organic motive fluid recuperator.

2. The system according to claim 1, wherein the first organic motive fluid flashing means comprises a high pressure organic motive fluid flash chamber for receiving the organic motive fluid exiting the heat exchanger and producing the high pressure organic vapor flashed portion supplied to said high pressure organic vapor turbine module, and the second organic motive fluid flashing means comprises a low pressure organic motive fluid flash chamber for receiving a non-flashed organic motive fluid discharge from said high pressure organic motive fluid flash chamber and producing the low pressure organic motive fluid flashed portion supplied to said low pressure organic vapor turbine module.

3. The system according to claim 2, wherein said organic motive fluid recuperator comprises a direct contact organic motive fluid recuperator, and wherein said cycle pump delivers the portion of the organic motive fluid condensate from said organic vapor condenser to said direct contact organic motive fluid recuperator for mixing with the high pressure organic vapor turbine module discharge vapor, whereby a mixed flow produced exiting said direct contact organic motive fluid recuperator is combined with the low pressure organic vapor flashed portion to produce the combined flow supplied to the low pressure organic vapor turbine module.

4. The system according to claim 3, wherein said further organic motive fluid recuperator is provided for heating said further portion of the organic motive fluid condensate from said organic vapor condenser using the low pressure turbine module organic vapor discharge.

5. The system according to claim 4, further comprising an organic motive fluid preheater for preheating the organic motive fluid recuperated condensate by means of a non-flashed organic motive fluid discharge from the low pressure organic motive fluid flash chamber.

6. The system according to claim 5, wherein heat depleted low pressure organic motive fluid flash chamber discharge is combined with the organic motive fluid condensate from the organic motive fluid recuperator.

7. The system according to claim 6, further comprising an organic motive fluid condensate pump for supplying the organic motive fluid condensate to the heat exchanger so as to ensure that the organic motive fluid condensate will remain in a liquid phase.

8. The system according to claim 3, further comprising a first control valve in communication with a fluid line extending from the high pressure organic motive fluid flash chamber to the high pressure organic vapor turbine module, and a second control valve in communication with a fluid line extending from the low pressure organic motive fluid flash chamber and the low pressure organic vapor turbine module.

9. The system according to claim 8 further comprising a third control valve in communication with a fluid line extending from the cycle pump to the direct contact organic motive fluid recuperator.

10. The system according to claim 8, further comprising a first safety valve in communication with a fluid line extending between the heat exchanger and the high pressure organic motive fluid flash chamber, and a second safety valve in communication with a fluid line upstream to the heat exchanger.

11. The system according to claim 10, further comprising a controller for controlling operation of the cycle pump, a first control valve, a second control valve, a first safety valve and a second safety valve in accordance with sensed operating conditions.

12. The system according to claim 9, further comprising a controller for controlling operation of the third control valve.

13. The system according to claim 7, further comprising a controller for controlling operation of the condensate pump, and condensate pump in accordance with sensed operating conditions.

14. The system according to claim 4, wherein the high pressure and low pressure organic vapor turbine modules are separate turbine modules coupled to a common generator.

15. The system according to claim 4, wherein the high pressure and low pressure organic vapor turbine modules are first and second stages, respectively, of a common organic vapor turbine coupled to a generator.

16. A waste heat recovery system, comprising:

a closed fluid circuit through which an organic motive fluid flows, a heat exchanger connected to receive waste heat combustion gases and communicating with said closed fluid circuit for transferring heat from the waste heat combustion gases to an organic motive fluid liquid flowing in said heat exchanger in said closed fluid circuit, first organic motive fluid flashing means connected to said closed fluid circuit at a position of the closed fluid circuit for flashing the organic motive fluid liquid which exits said heat exchanger into a high pressure flashed organic motive fluid vapor portion, second organic motive fluid flashing means connected to said closed fluid circuit at a position of the closed fluid circuit for flashing liquid remaining non-flashed organic motive fluid, producing a low pressure flashed organic motive fluid vapor portion, an organic vapor turbine for producing power having a high pressure stage connected to said closed fluid circuit at a position of the closed fluid circuit to receive said high pressure flashed organic motive fluid vapor portion directly from the first organic motive fluid flashing means, a low pressure stage connected to said closed fluid circuit at a position of the closed fluid circuit to directly receive a combined flow of organic motive fluid vapor comprising said low pressure flashed organic motive fluid vapor portion from the second organic motive fluid flashing means and discharge organic motive fluid vapor from said high pressure stage whereby additional power is produced by said turbine, an organic motive fluid recuperator for receiving high pressure organic vapor discharged from said high pressure organic vapor turbine module, a further organic motive fluid recuperator for receiving low pressure organic vapor discharged from said low pressure organic vapor turbine module, and an organic vapor condenser for condensing discharge organic vapor from the low pressure organic vapor turbine module, the organic vapor condenser producing organic motive fluid condensate for supply to said heat exchanger, and a cycle pump for delivering a portion of the organic motive fluid condensate to said organic motive fluid recuperator and for delivering a further portion of the organic motive fluid condensate to said further organic motive fluid recuperator.

17. The system according to claim 1, wherein the heat exchanger communicates with a source of waste heat combustion gases at about 500° C.

18. The system according to claim 16, wherein the heat exchanger communicates with a source of waste heat combustion gases at about 500° C.

* * * * *